United States Patent [19]

Dow

[11] 4,338,979

[45] Jul. 13, 1982

[54] BAG HOLDING DEVICE AND PROCESS

[76] Inventor: Ray A. Dow, 412 NE. Wilshire, Bartlesville, Okla. 74003

[21] Appl. No.: 205,948

[22] Filed: Nov. 12, 1980

[51] Int. Cl.[3] ..... B65B 1/04

[52] U.S. Cl. ..... 141/10; 141/316; 141/390; 220/404; 248/97; 248/101

[58] Field of Search ..... 141/10, 67, 68, 114, 141/312–317, 390, 3 A; 220/403, 404, 462, 463; 248/97, 99, 101

[56] References Cited

U.S. PATENT DOCUMENTS 1,211,278 1/1917 Blum ..... 141/390

*Primary Examiner*—Frederick R. Schmidt

*Attorney, Agent, or Firm*—John H. Widdowson

[57] ABSTRACT

A process for holding a bag and a bag holding device. The device includes a box-like structure having a pair of side walls joined to a pair of end walls along corner score lines. The structure has a corner structure defining a notch in at least two of the corner score lines. Elastic band encircles the outside of the box-like structure while residing in the notch. The process comprises the steps of notching the corner score lines of a collapsible box-like structure having a pair of side walls joined to a pair of end walls along the corner score lines; inserting the bag into the mouth of the structure; overlapping the periphery of the mouth of the bag over the edge of the mouth of the structure; encircling the overlapping portion of the bag with the elastic band; and lodging the elastic band over the overlapping portion of the bag and within the notches at the corner score lines so as to hold the bag in an open position and prevent displacement of the bag from the structure.

7 Claims, 7 Drawing Figures

FIG. 6
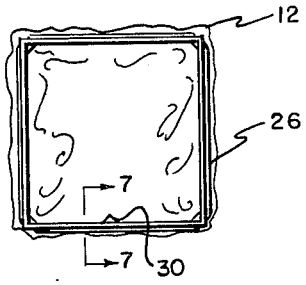
FIG. 1
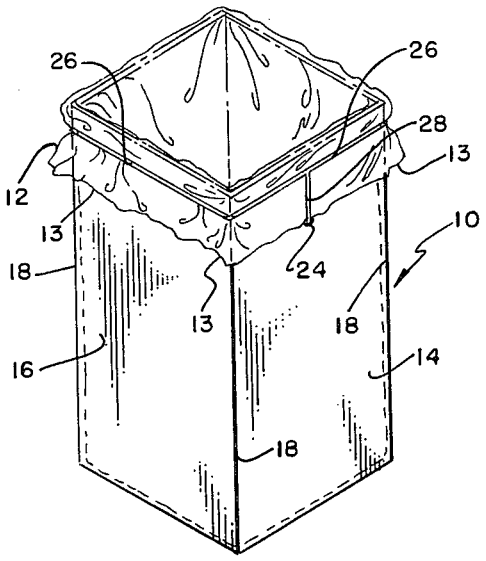
FIG. 7
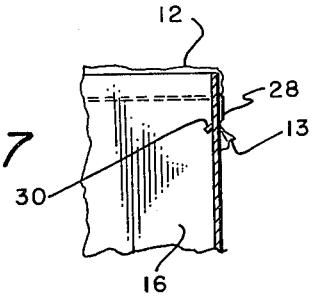
FIG. 2
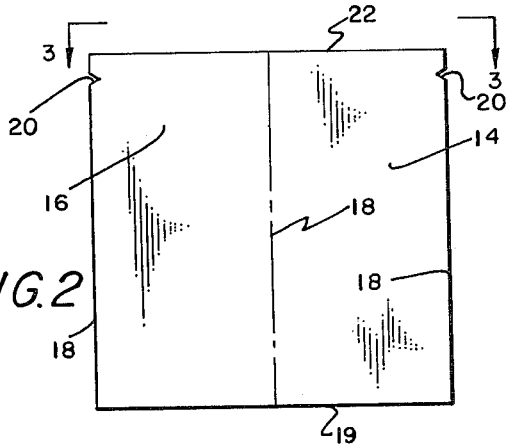
FIG. 3
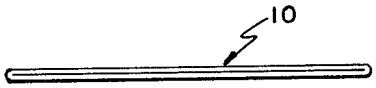
FIG. 4
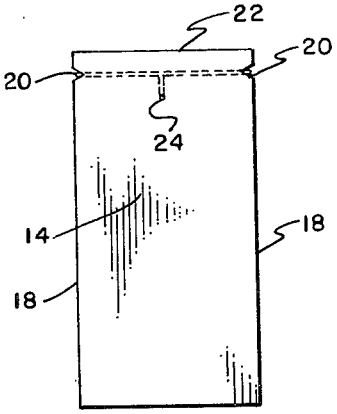
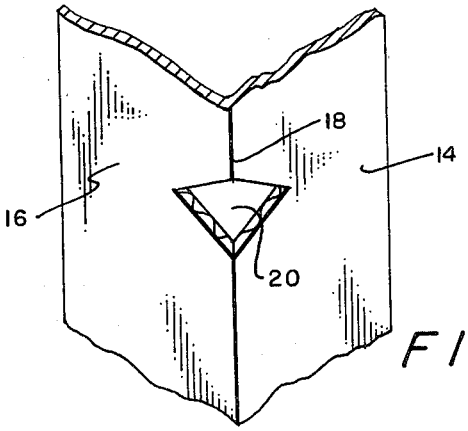
FIG. 5

BAG HOLDING DEVICE AND PROCESS

BACKGROUND OF THE INVENTION

1. Field of the Invention

This invention is related to a bag holder. More specifically, this invention provides for a bag holding device and a process for holding a bag.

2. Description of the Prior Art

U.S. Pat. No. 4,037,778 by Boyle discloses a bag support wherein the form is folded and collapsible cardboard insert for a plastic bag or the like so that the same may be held open for inserting whatever material is to be placed therein. U.S. Pat. No. 4,064,969 by Black discloses a bag for receiving drained oil from the crankcase of a vehicle. The bag has a collapsible insert in the mouth. None of the foregoing prior art teaches or suggests the particular bag holding device and process for holding a bag of this invention.

SUMMARY OF THE INVENTION

This invention accomplishes its desired objects by providing a process for holding a bag and a novel arrangement of parts for a device for holding a bag comprising a box-like structure including a pair of side walls joined to a pair of end walls along corner score lines. The structure folds along the corner score lines into a generally flat posture. The box-like structure has a corner structure defining a notch in at least two of the corner score lines. Elastic means encircles the outside of the box-like structure while residing in the notch. The device is adapted for inserting into the mouth of the bag and overlapping the periphery of the mouth of the bag over an edge of the box-like structure, and the elastic means encircles the overlapping portion of the bag and lodges within the notches at the corners of the box-like structure so as to hold the bag in an open position and prevent displacement of the bag from the device. The process for holding a bag comprises: notching at least two corner score lines of a collapsible box-like structure including a pair of side walls joined to a pair of end walls along the corner score lines; inserting the bag into the mouth of the structure; overlapping the periphery of the mouth of the bag over an edge of the mouth of the structure; encircling the overlapping portion of the bag with an elastic means; and lodging the elastic means over the overlapping portion of the bag and within the notches at the corner score lines so as to hold the bag in an open position and prevent displacement of the bag from the structure.

It is an object of the invention to provide a novel process for holding a bag and a novel bag holding device.

Still further objects of the invention reside in the provision of a process for holding a bag, and a bag holding device which can be relatively inexpensive to manufacture.

These together with the various ancillary objects and features will become apparent as the following description proceeds, are attained by this bag holding device, preferred embodiment being shown in the accompanying drawings, by way of example only, wherein:

BRIEF DESCRIPTION OF THE DRAWINGS

FIG. 1 is a perspective view of the invention having a bag overlapping the top edges thereof and an elastic band retaining same;

FIG. 2 is a side elevational view of the invention folded in a collapsible flat position;

FIG. 3 is a top plan view taken in direction of the arrows along the plane of line 3—3 in FIG. 2;

FIG. 4 is a side elevational view of the invention with the elastic band indicated in dotted lines;

FIG. 5 is an enlarged partial perspective view of a notched corner score line;

FIG. 6 is a top plan view of the invention including an overlapping bag; and

FIG. 7 is a partial vertical sectional view taken in direction of the arrows along the plane of line 7—7 in FIG. 6.

DETAILED DESCRIPTION OF THE INVENTION

Referring in detail now to the drawings, wherein similar parts of the invention are identified by like reference numerals, there is seen the device, generally illustrated as 10, for holding a bag 12 having a mouth periphery edge 13. Device 10 is a box-like structure having a pair of side walls 14—14 joined to a pair of end walls 16—16 along corner score lines 18 and an open bottom end 19. The structure of the device 10 folds along the corner score lines 18 into a generally flat posture as evidenced in FIGS. 2 and 3. A notch 20 is situated in at least two of the corner score lines 18 (see FIGS. 2, 4 and 5) in close proximity to a mouth-edge 22 of the box-like structure. In a preferred embodiment of the invention notch 20 is in at least two corner score lines 18 that are (diagonally) opposed from each other. At least one side wall 14, or at least one end wall 16, has a rubber band extension aperture 24 in proximity to the mouth-edge 22 (see FIGS. 1 and 4) of the device 10. A rubber band 26, having integrally bound therewith an extension band 28 (see FIG. 1) including an extension plug 30 (see FIGS. 6 and 7) having a diameter larger than the diameter of aperture 24 for retainably lodging therebehind, encircles the outside of the box-like device 10 while lodging in the notch 18.

With continuing reference to the drawings for operation of the invention and the process for holding the bag 12, the bag 12 is inserted into (or through) the mouth-edge 22 of the device 10, or through the bottom end 19 of the device 10. Mouth periphery edge 13 of the bag 12 is overlapped over the mouth-edge 22 of the box-like device 10. The elastic band 26, which is normally and generally secured to box-like structure 10 via extension band 28 having its extension plug 30 secured behind aperture 24, encircles the overlapped mouth periphery edge 13 of bag 13 and lodges same within notches 20 at the corner score lines 18 so as to hold the bag 12 in an open position and to prevent displacement of the bag 12 from the device 10. The extension band 28 and plug 30 are below the dotted rubber band line (see FIG. 4) and hold the rubber band 26 to box-like device 10 while the mouth periphery edge 13 of the bag 12 is being folded over the mouth-edge 22 of the device 10. The mouth periphery edge 13 of the bag 12 is capable of being folded or extended down to the extension aperture 24 (see FIG. 1) of either side wall 14 or end wall 16, and extension band 28 aids elastic band 26 in retaining bag 12 to the device 10.

Having thus described my invention, what I claim as new and desire to secure by Letters Patent is:

1. A device for holding a bag comprising a box-like structure including a pair of side walls joined to a pair of end walls along corner score lines, said structure folding along said corner score lines into a generally flat posture; said box-like structure having corner structure defining a notch in at least two of said corner score lines; elastic means for encircling the outside of the box-like structure while residing in said notch, said device being adapted for inserting the bag into the structure and overlapping the periphery of the mouth of the bag over an edge of the box-like structure and said elastic means encircling the overlapping portion of said bag and lodging within the notches at the corners of the box-like structure so as to hold the bag in an open position and prevent displacement of the bag from the device; at least one of said side walls and at least one of said end walls each having a structure defining a rubber band extension aperture, said elastic means being retained in said extension apertures of said side and end walls simultaneously to encircling said structure and residing in said notch.

2. The device of claim 1 wherein said notch in at least two of said corner score lines is in opposed corners.

3. The device of claim 1 wherein each of said corner score lines include a notch.

4. The device of claim 1 wherein said notches in said corner score lines are in close proximity to an edge of the box-like structure.

5. A process for holding a bag comprising the steps of:

(a) notching at least two corner score lines of a collapsible box-like structure including a pair of side walls joined to a pair of end walls along said corner score lines, said structure having a mouth and folding along said corner score lines into a generally flat posture; at least one of said side walls and at least one of said end walls each having a structure defining a rubber band extension aperture;

(b) inserting said bag into the mouth of said structure;

(c) overlapping the periphery of the mouth of the bag over an edge of the mouth of said structure;

(d) encircling the overlapping portion of the bag with an elastic means;

(e) lodging the elastic means over the overlapping portion of the bag and within the notches at the corner score lines so as to hold the bag in an open position and prevent displacement of the bag from the structure; and (f) retaining said elastic means in said extension apertures of said side and end walls simultaneously to lodging within the notches so as to strengthen the prevention of the displacement of the bag from the structure.

6. The process of claim 5 wherein said notching step (a) is done in opposed corner score lines.

7. The process of claim 6 additionally comprising extending the periphery of the mouth of the bag down to said extension aperture.

* * * * *